US006790289B2

(12) United States Patent
Takase et al.

(10) Patent No.: US 6,790,289 B2
(45) Date of Patent: Sep. 14, 2004

(54) METHOD OF CLEANING A PLASMA PROCESSING APPARATUS

(75) Inventors: Taira Takase, Nirasaki (JP); Nobuyuki Nagayama, Nirasaki (JP); Kouji Mitsuhashi, Nirasaki (JP); Hiroyuki Nakayama, Nirasaki (JP)

(73) Assignee: Tokyo Electric Limited, Tokyo (JP)

( * ) Notice: Subject to any disclaimer, the term of this patent is extended or adjusted under 35 U.S.C. 154(b) by 0 days.

(21) Appl. No.: 10/385,571

(22) Filed: Mar. 12, 2003

(65) Prior Publication Data

US 2003/0172952 A1 Sep. 18, 2003

(30) Foreign Application Priority Data

Mar. 18, 2002 (JP) ..... 2002-073957

(51) Int. Cl.[7] ..... B08B 7/02

(52) U.S. Cl. ..... 134/1; 134/1; 134/1.3; 134/6; 134/7; 134/8; 134/22.1; 134/22.18; 134/26; 134/28; 134/42; 134/902

(58) Field of Search ..... 134/1, 1.3, 6, 7, 134/8, 22.1, 22.18, 22.19, 26, 28, 42, 902

(56) References Cited

U.S. PATENT DOCUMENTS 3,599,871 A * 8/1971 Ruppel et al. ..... 239/227
5,108,512 A * 4/1992 Goffnett et al. ..... 134/7
5,109,562 A * 5/1992 Albrecht ..... 15/56
5,391,275 A * 2/1995 Mintz ..... 204/192.32
5,401,319 A * 3/1995 Banholzer et al. ..... 134/1
6,197,123 B1 * 3/2001 Poag et al. ..... 134/18
6,352,081 B1 * 3/2002 Lu et al. ..... 134/22.1
6,394,107 B1 * 5/2002 Kesari et al. ..... 134/22.1
2002/0086118 A1 * 7/2002 Chang et al. ..... 427/447
2003/0010353 A1 * 1/2003 Kawasaki et al. ..... 134/1
2003/0150476 A1 * 8/2003 Suzuki ..... 134/1

FOREIGN PATENT DOCUMENTS

JP 3030287 * 4/2000

* cited by examiner

*Primary Examiner*—Randy Gulakowski
*Assistant Examiner*—Sharidan Carrillo
(74) *Attorney, Agent, or Firm*—Oblon, Spivak, McClelland, Maier & Neustadt, P.C.

(57) ABSTRACT

There is provided a method of cleaning completely a deposit on the surface of the member to be cleaned, of a plasma processing apparatus without any damage of the coating which has been formed anodized coating or sprayed coating on the surface of the member to cleaned. The method of cleaning comprises a chemical cleaning step of dipping in an organic solvent (e.g. acetone) (a); and then a step blowing pressurized air so as to remove the deposit which has been peeled from a buffer plate (14) treated chemically (b); and then, of removing physically the deposit remained at the edges of the buffer plate (14) by blasting by using a $CO_2$ blast apparatus (105), and f steps of dipping the buffer plate (14) in pure water (104), and imparting supersonic vibration to remove the deposit remaining on a buffer plate (14).

14 Claims, 3 Drawing Sheets

【FIG. 1】
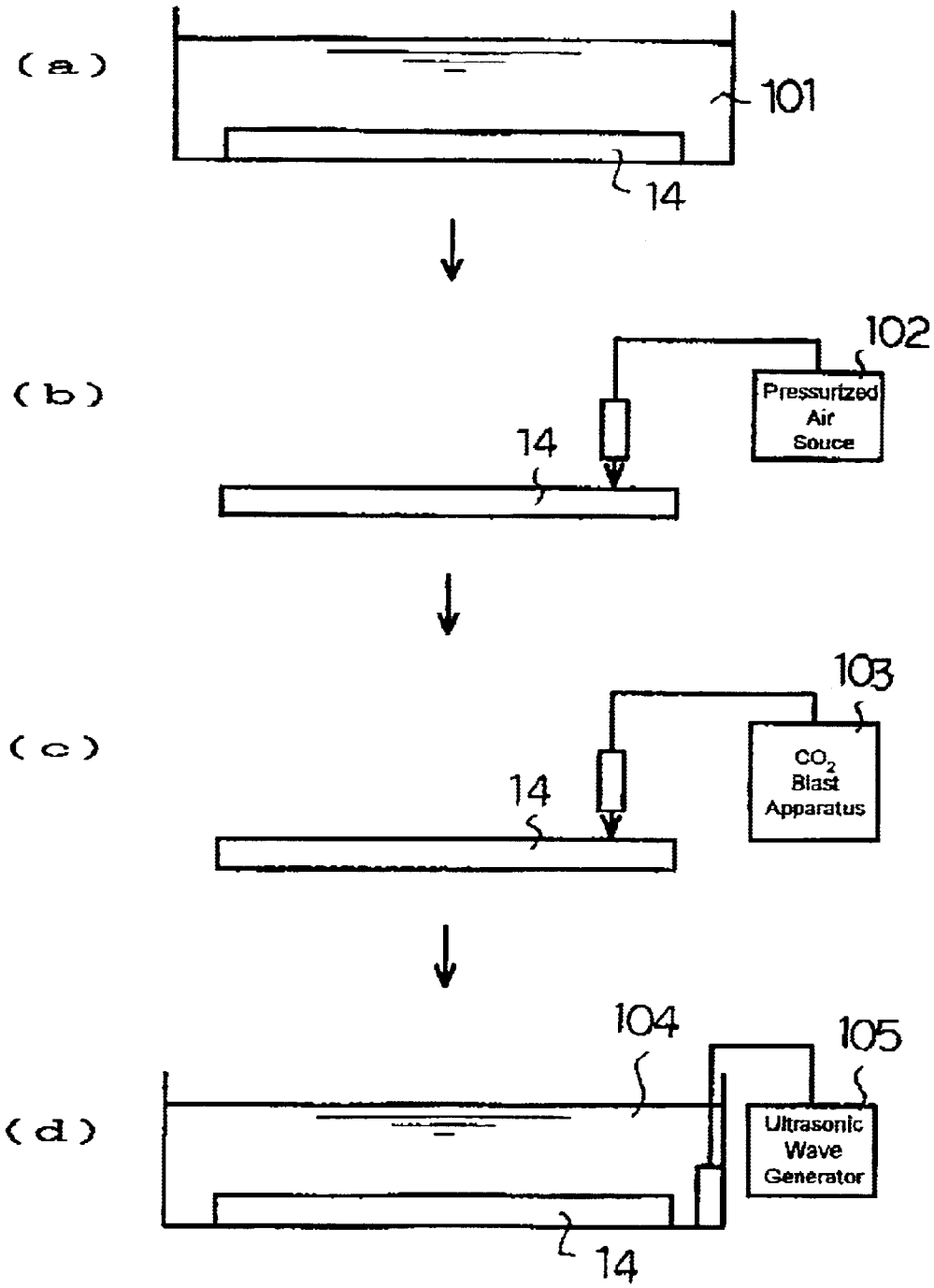

【FIG. 2】
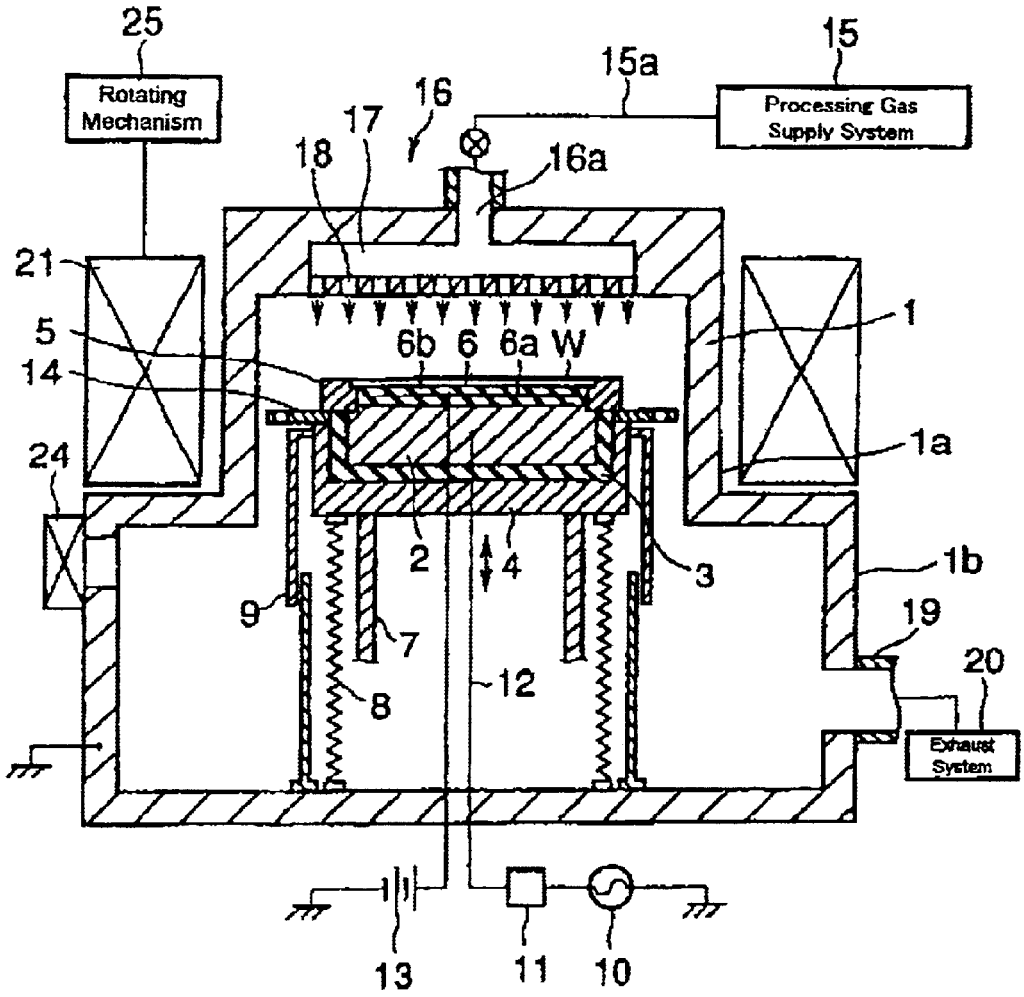

【FIG. 3】
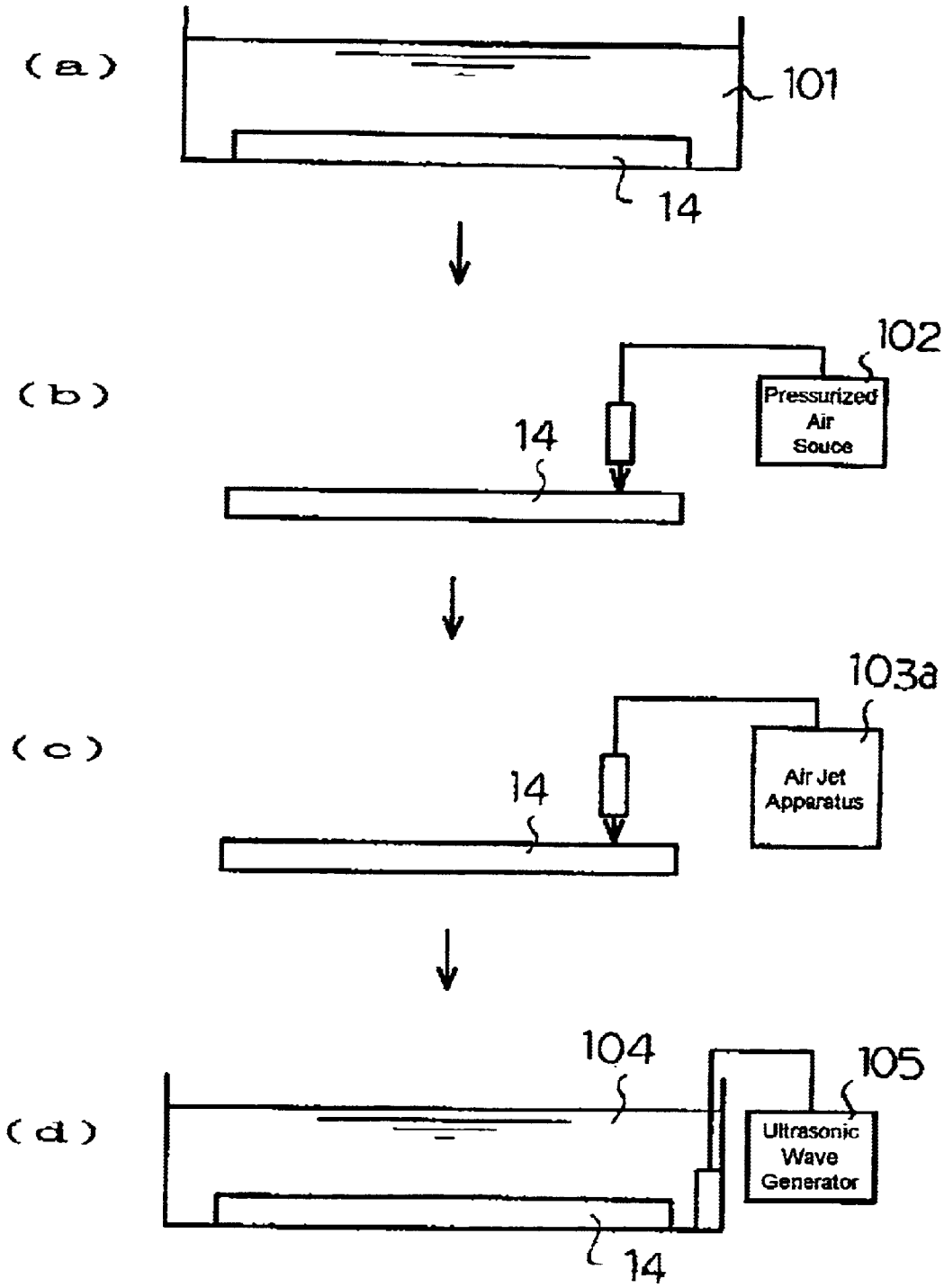

METHOD OF CLEANING A PLASMA PROCESSING APPARATUS

CROSS REFERENCE TO RELATED APPLICATIONS

This application is based upon and claims the benefit of priority from the prior Japanese Patent Application No. 2002-073957, filed on Mar. 18, 2002; the entire contents of which are incorporated herein by reference.

BACKGROUND OF THE INVENTION

1. Field of the Invention

The present invention relates to a method of cleaning a deposit as formed by processing e.g. plasma etching of silicone oxide coating by using CF series gas, and a plasma processing apparatus which is cleaned by this method.

2. Description of the Related Art

There has been used frequently a plasma processing apparatus for etching a desired position of a semiconductor device, in the manufacture of the fine structure of the semiconductor device.

In such etching apparatus, a deposit as formed during the etching process in the etching chamber is frequently formed and accumulated, wherein a silicone oxide coating is etched by using an etching gas containing fluorine gas e.g. CF series compounds. Therefore, the cleaning of such deposit from the etching apparatus has to be periodically exerted.

The prior art etching apparatus for cleaning has been using a chemical cleaning with a cleaning liquid such as an organic solvent, or alternatively a physical cleaning such as water jet, air jet and the like.

As discussed above, the prior art cleaning technology for cleaning a deposit formed in a processing chamber in which a silicon oxide is etched by using CF series gas has use a chemical cleaning using a cleaning liquid such as an organic solvent, or alternatively physical cleaning using water jet or air jet.

However, among the above mentioned conventional methods of cleaning, a mere chemical cleaning step can not remove completely the deposit formed at a fine part of the member to be cleaned, such as an edge part thereof. On the other hand, a physical cleaning method such as use of water jet or air jet might impart some damage or peeling phenomenon on a deposit such as anodic oxide coating and/or a sprayed coating, when such deposit as anodic oxide coating and/or a sprayed coating are formed on the surface of the member to be cleaned.

The present invention has been attained under the consideration of such situation, and will provide a method of cleaning completely a deposit formed in the inside of a plasma processing apparatus (chamber) by processing with plasma coatings without any of damage of the deposit such as anodic oxide coating (anodized aluminium coating) and/or a sprayed coating as deposited on the surface of the member to be cleaned.

The present invention has been developed so as to solve the above mentioned problems.

SUMMARY OF THE INVENTION

In accordance with the first embodiment of the present invention, there is provided a method of cleaning a deposit formed in the inside of a plasma processing apparatus by processing with plasma coatings to be treated of a substrate by introducing a processing gas containing at least fluorine gas into the chamber, which comprises in sequence a chemical cleaning step of removing chemically the deposit by contacting a member to be cleaned having the deposit thereon with a cleaning liquid for a predetermined period, and a step of removing physically the deposit by blasting with a cleaning media the member to be cleaned, after said chemical cleaning step.

In accordance with the second embodiment of the present invention, said cleaning liquid may contain at least organic solvent.

In accordance with the third embodiment of the present invention, the organic solvent may include at least one species selected from the group consisting of ethanol, isopropyl alcohol, butanol, acetone, methyl ethyl ketone and methyl butyl ketone.

In accordance with the fourth embodiment of the present invention, the physical cleaning step is carried out by $CO_2$ blasting step of blasting dry ice pellet with pressurized air.

In accordance with the fifth embodiment of the present invention, the pressure of air for the $CO_2$ blasting step ranges 3.0 to 4.2 kg/cm$^2$.

In accordance with the sixth embodiment of the present invention, the size of the dry ice pellet for the $CO_2$ blasting step may range 0.3 mm to 0.6 mm.

In accordance with the seventh embodiment of the present invention, said physical cleaning is carried out by air jet cleaning with pressurized air and high pressure water.

In accordance with the eighth embodiment of the present invention, said air jet cleaning is carried out at water pressure of 7 to 14 MPa and air pressure of 0.2 to 0.35 MPa.

In accordance with the ninth embodiment of the present invention, an anodic oxide deposit or sprayed coating have been formed on the surface of the member to be cleaned.

In accordance with the tenth embodiment of the present invention, the method comprises further a step of exposing to air purge the member to be cleaned between the chemical step and the physical step.

In accordance with the embodiment of the present invention, the member to be cleaned is dipped in pure water after the physical cleaning step, so as to clean with supersonic vibration as generated by supersonic.

In accordance with the present invention, there is provided a method of cleaning a deposit generated by a processing gas containing fluorine gas in a plasma processing apparatus which comprises in sequence a chemical step of removing chemically the deposit by contacting a substance to be cleaned which has been deposited, with a cleaning liquid for a predetermined period; and a physical step of removing physically the deposit by blasting a cleaning media to the member to be cleaned, after said chemical step.

In accordance with the embodiment of the present invention, there is provided an apparatus for cleaning a deposit formed by treating with a processing gas containing fluorine gas into the chamber, which comprises, a chemical remover of the deposit by contacting a member to be cleaned having the deposit thereon with a cleaning processing liquid for a predetermined period, and a physical remover of the deposit by blasting a cleaning media to the member to be cleaned, after said chemical remover.

BRIEF DESCRIPTION OF THE DRAWINGS

FIG. 1 is a view illustrating schematically one embodiment of the method of cleaning in accordance with the present invention.

FIG. 2 shows a schematic structure of the plasma etching apparatus.

FIG. 3 is a view illustrating schematically another embodiment of the method of cleaning in accordance with the present invention.

DETAILED DESCRIPTION

In reference to the drawings, the embodiments of the present invention will be explained as follows.

FIG. 2 is a view illustrating schematically a structure of the etching apparatus, in which 1 indicates a cylindrical vacuum chamber made of aluminium, and the inside thereof is sealed closely for plasma processing chamber.

The vacuum chamber 1 has a stepped cylindrical form having an upper portion 1*a* with smaller diameter, and a lower portion 1*b* with larger diameter, and is electrically connected to the ground. Further, there is provided in the inside of the vacuum chamber 1, a support table (suscepter) 2 for supporting a semiconductor wafer W as a substrate to be processed, positioning the surface thereof to be processed, up and almost horizontally.

This support table 2 is made e.g. of aluminium, and supported by a support base 4 through an insulating board 3 such as ceramic board. Further, there is provided at upper rim of the support table 2 a focus ring 5 made of conductive or insulating material.

Further, there is provided an electrostatic chuck 6 to adsorb electrostatically a semiconductor wafer W, on the top surface of the semiconductor wafer W. This electrostatic chuck 6 has an electrostatic electrode 6*a* within an insulating member 6*b*, in which the electrode 6*a* is connected to a direct current source 13. The electrode 6*a* is charged from the source 13 to apply voltage, and then the semiconductor wafer W can be adsorbed by a Coulomb force.

Further, there is mounted on the support table 2 a cooling media channel (not shown) and a gas introducing channel (not shown) for feeding He gas to the back surface of the semiconductor water W to cool efficiently the semiconductor wafer W, so that the temperature of the wafer can be controlled at desired temperature.

The support table 2 and the support base 4 can be elevated by a ball screw mechanism having a ball screw 7, and a driving means provided below the support base 4 is housed with bellows 8 made from stainless steel (SUS), which is further covered with bellows cover 9.

A supply lead 12 for supply of power to feed high frequency power is provide and connected about the center of the support table 2. This supply lead 12 is connected to a matching box 11 and a high frequency source 10 in which the high frequency power with the frequency ranging 13.56 to 150 MHz is fed from the source 10 to the support table 2.

A buffer plate 14 having a number of slits as formed is provided in form of ring at skirt of the focus ring 5, in which the space of the vacuum chamber 1 is exhausted to vacuum with an exhaust mechanism 20 connecting through an exhaust port 19 via this buffer plate 14.

On the other hand, a shower head 16 is provided at a ceiling of the vacuum chamber above the support table 2, facing and parallel to the support table 2, and is connected to the ground. Therefore, the support table 2 and the shower head 16 form a pair of electrodes, and then function as the pair of electrodes.

The shower head 16 has a number of gas inject pores 18 on the under surface thereof, and a gas introducing port 16 on the upper portion thereof. Further, a space 17 for gas defusing is formed inside thereof. The gas introducing port 16 is connected to a processing gas feed pipe 15*a* to the other end of which a processing gas feed source 15 is connected for feeding a processing gas to etch (etching gas).

A gate valve 24 to open and close the carrier port for the semiconductor wafer W is provided on the upper portion of the outside wall of the lower portion of the vacuum chamber 1.

On the other hand, a mechanism 21 for forming ring magnetic field is provided concentrically with the vacuum chamber 1 around the outside wall of the upper portion of the vacuum chamber 1, so as to form a magnetic field in the space between the support table 2 and the shower head 16. This mechanism 21 can rotate around the vacuum chamber 1 at given rotation rate.

The plasma etching apparatus as described will etch a silicone oxide coating as formed on the semiconductor wafer W by using an etching gas which may include CF series gas, e.g. molecular containing carbon and fluorine atoms, such as $CH_2F_2$, $C_4F_6$, $C_5F_8$ (cyclic and straight), $CF_4$, $CHF_3$, $C_4F_8$ (cyclic and straight).

This etching procedure will explained as follows: Firstly, the gate valve 24 is open, and then a semiconductor wafer W is introduced into a vacuum chamber 1 by using a carrier mechanism (not shown) through a load lock chamber (not shown) positioned in the neighbor of the gate valve (24), and then, put on the support table 2 lowered at the predetermined level. Then, the electrode 6*a* of the electrostatic chuck 6 is charged from the direct current source 13 at the given voltage, so that the semiconductor wafer W is adsorbed by Coulomb force.

Thereafter, after the carrier mechanism is put out of the vacuum chamber 1, the gate valve 24 is closed, then the support table 2 is elevated to the position as shown in FIG. 2, and the chamber 1 is exhausted to vacuum by a vacuum pump of an exhaust system 20 through an exhaust port 19.

After the chamber 1 is exhausted to a given degree of vacuum, the given etching gas is fed into the vacuum chamber 1 from a processing gas supply 15 at a given flow rate, so that the pressure of the vacuum chamber is kept at given value, e.g. 1.33 Pa to 133 Pa (10 mTorr to 1000 mTorr).

Under such condition, a high frequency power (e.g. 13.56 MHz) is applied to the support table 2 from a high frequency source 10.

In this case, a high frequency field is formed within a processing space between a shower head 16 as an upper electrode and a support table 2 as a lower electrode, and at the same time, a magnetic field due to a magnetic field formation mechanism 21 is formed, and then, under such condition the etching procedure to etch the silicon oxide coating is exerted.

After the given etching procedure is finished, the high frequency power from the high frequency source 10 is stopped to finish the etching procedure, and then, a reverse procedure to discharge the wafer is exerted to discharge the finished wafer W from the vacuum chamber 1.

Such procedure is repeated and then, when the total period of the etching procedure reaches 5 hours, the buffer plate 14 is put out of the vacuum chamber 1 and then cleaned.

The buffer plate 14 is made of circular board in which a number of slits are formed radially, and on the surface thereof is an aluminium sprayed coating applied.

The buffer plate 14 as taken out or discharged from the vacuum chamber 1 has a plenty of deposit as a layered on the surface thereof.

The buffer plate 14 on which the deposit is coated is dipped as shown FIG. 1 in an organic solvent 101 (e.g. acetone) as a cleaning liquid for chemical cleaning. The chemical cleaning is continued for given period (e.g. 1 to 12 hours), and then the buffer plate 14 is put out of the organic solvent 100.

Then, the deposit as peeled or removed from the surface of the buffer plate 14 is further removed completely from the plate by blowing with pressurized air (air purge) (b). When this step is finished, most of the deposit is removed from the surface of the buffer plate 14, however, the deposits as formed at the edges of the slits might remain.

Therefore, $CO_2$ blast is applied to such buffer plate 14 by a blast apparatus 103 so as to remove completely the deposits which might remain at the edges of the buffer plate 14 (c).

In such physical cleaning by a $CO_2$ blast apparatus 103, dry ice pellets are blown by pressurized air, to inject from a nozzle thereby making collision to the buffer plate 14 so that the deposit should be removed from the buffer plate. Further, the deposit is exposed to thermal shock to produce micro-cracks therein and further the expansion energy as generated by sublimating the dry ice pellets will remove the deposit from the buffer plate.

The pressure of pressurized air for physical cleaning by the $CO_2$ blast apparatus 103 ranges e.g. 3.0 kg/cm$^2$ to 4.2 kg/cm$^2$, and the size of the dry ice pellets ranges e.g. 0.3 mm to 0.6 mm. The period necessary to remove physically by the $CO_2$ blast apparatus 103 is about 10 minutes.

When the pressure of pressurized air for physical cleaning by the $CO_2$ blast apparatus 103 is too high, the coating as formed on the buffer plate 14 may be damaged. In contrast, when the pressure of pressurized air is too low, the period to remove completely the deposit may be longer. Therefore, the above mentioned preferable pressure may be good.

Even when the pressure of pressurized air is within the above preferable range, the longer physical cleaning by the $CO_2$ blast apparatus 103 may be predicted to make serious damage on the coating as formed. However, when the chemical cleaning is exerted by the above mentioned method with the organic solvent before the physical cleaning, most of the deposit may be removed by this chemical cleaning, and therefore, the period necessary for the physical cleaning would be shortened, so that the damage on the coating as formed can be less.

Further, the state of the deposit at the time when the chemical cleaning with an organic solvent is finished seems constant regardless of the amount of the deposit at the beginning of the cleaning, and further only a deposit at the edges of the slit ends might remain. Accordingly, the period necessary for the physical cleaning by the $CO_2$ blast apparatus 103 might be constant (about 10 minutes) regardless of the amount of the deposit at the beginning of the cleaning, and therefore, the coating could not be damaged by the physical cleaning. This is advantageous in that the period necessary for the physical cleaning might be constant and can be short even when the amount of the deposit is different each other apparatus.

When the physical cleaning step by $CO_2$ blast apparatus 103 is finished, the deposit remaining on the edges of the buffer plate 14 can be completely removed, but there is not found that the alumina sprayed coating which has been formed before on the surface of the buffer plate 14 could be damaged.

Finally, the buffer plate 14 is dipped in a pure water 104 so that a supersonic wave generator 105 imparts a supersonic vibration to the pure water 104, so as to make supersonic cleaning (rinsing) of the buffer plate 14.

The deposit formed on the surface of the buffer plate 14 can be completely removed without any of damage on the coating (thickness thereof being about 200 micrometer) of alumina sprayed layer formed on the surface of the buffer plate 14.

In the above mentioned embodiment of the present invention, the case using acetone which can be an organic solvent, as a cleaning liquid for use in the chemical cleaning is illustrated, however, the other cleaning liquid than acetone can be alternatively used as well, and further the other organic solvent can be alternatively used for cleaning liquid.

For example, a mixture of hydrofluoro ether (available as a HFE-7100; registered trademark, from Sumitomo Three M Co.) and IPA (isopropyl alcohol) is used for a cleaning liquid, in the same way as described above, and then, the result of the cleaning is good as well as the above described solvent.

Alcohol analogous such as ethanol, isopropyl alcohol and 1-butanol, and ketones such as methyl ethyl ketone can be used for the chemical cleaning other than the above mentioned solvents.

In reference to the above mentioned embodiment, the case in which an alumina sprayed coating has been formed on the surface of the buffer plate 14 is illustrated. The cleaning method as well as the above mentioned can be applied to the case in which anodic oxide coating has been formed (in thickness of about 50 micrometer) on the surface of the buffer plate 14, resulting in that the deposit formed on the surface of the buffer plate 14 can be completely removed without any of damage on the anodic oxide coating.

FIG. 3 illustrates the other embodiment of the present invention. In this embodiment, an air jet method using air jet apparatus 103*a* in stead of the $CO_2$ blast apparatus 103 is used for the physical cleaning of the present invention to attain the physical cleaning by air jet. The other condition for physical cleaning is the same as that as shown in FIG. 1.

The above mentioned air jet apparatus 103*a* is for exerting of the physical cleaning in which high pressure water is mixed with compressed air so as to inject against the buffer plate 14, thereby removing physically the deposit formed on the buffer plate 14. The pressure of water as used in this physical cleaning by air jet apparatus 103*a* ranges e.g. 7 to 14 MPa, and the pressure of air jet is e.g. 0.2 to 0.35 MPa. When these pressures are too high, the coating as formed on the surface of the buffer plate 14 might be damaged. Further, when these pressure are too low, thae period for the deposit to be removed might be longer. Therefore, these pressures should be within the above mentioned ranges. Then, the period necessary to attain complete physical removal by air jet apparatus 103*a* is about 8 minutes.

As illustrate above, even when the air jet apparatus 103*a* is used for physical cleaning, in stead of the $CO_2$ blast apparatus 103, the deposit could be completely removed from the surface of the buffer plate 14 without any of damage on the coating made of alumina sprayed coating and the coating made of anodic oxide coating as formed on the surface of the buffer plate 14.

The results of the cleaning are good even when the cleaning liquid for chemical cleaning is acetone as well as when it is a mixture of HFE-7100 (trademark: available from Sumitomo Three M Co.) with IPA (isopropyl alcohol).

In the above mentioned embodiment, the cleaning in accordance with the present invention is described for the buffer plate 14, but this cleaning can be used for the other members of the vacuum chamber.

The above mentioned embodiments use CF series gas as an etching gas, the other processing gas such as gas not-containing carbon atom and containing fluorine atom, e.g. $NF_3$ and $SF_6$ can be used for etching gas. Further, in the above mentioned embodiments the cleaning of the etching apparatus has been illustrated, but the other plasma apparatus such as a plasma CVD apparatus can be cleaned in accordance with the present invention.

In accordance with the present invention, the deposit as formed on the member to be cleaned can be completely removed without any of damage affecting the anodic oxide coating and sprayed coating which have been formed on the surface of the members to be cleaned.

What is claimed is:

1. A method of cleaning a member on which a deposit is formed, the deposit being formed during plasma processing of a substrate with a processing gas containing at least fluorine gas, which comprises:

in sequence a chemical cleaning step of removing chemically the deposit by contacting the member to be cleaned having the deposit thereon with a cleaning liquid for a predetermined period; and then, a physical cleaning step of removing physically the deposit by blasting with a cleaning media the member to be cleaned, after said chemical cleaning step.

2. The method as claimed in claim 1, wherein said cleaning liquid contains at least an organic solvent.

3. The method as claimed in claim 2, wherein said organic solvent contains at least one species selected from the group consisting of ethanol, isopropyl alcohol, butanol, acetone, methyl ethyl ketone and methyl butyl ketone.

4. The method as claimed in claim 1, wherein said physical cleaning step is carried out by $CO_2$ blasting step of blasting dry ice pellet with pressurized air.

5. The method as claimed in claim 4, wherein the pressure of air for the $CO_2$ blasting step ranges 3.0 to 4.2 kg/cm$^2$.

6. The method as claimed in claim 4, wherein the size of the dry ice pellet for the $CO_2$ blasting step ranges 0.3 mm to 0.6 mm.

7. The method as claimed in claim 1, wherein said physical cleaning step is carried out by air jet cleaning with pressurized air and pressurized water.

8. The method as claimed in claim 7, wherein said air jet cleaning is carried out at a water pressure of 7 to 14 MPa and air pressure of 0.2 to 0.35 MPa.

9. The method as claimed in claim 1, wherein an anodic oxide coating or sprayed coating have been formed on a surface of the member to be cleaned.

10. The method as claimed in claim 1, wherein the method comprises further a step of purging of the deposit from the member to be cleaned by pressurized air, between the chemical step and the physical step.

11. The method as claimed in claim 1, wherein the member to be cleaned is dipped in purified water after the physical cleaning step, so as to clean with a supersonic vibration as generated by a supersonic.

12. A method of cleaning a member on which a deposit is formed, the deposit being generated by a processing gas containing fluorine gas in a plasma processing apparatus, which comprises: in sequence a chemical step of removing chemically the deposit by contacting the member to be cleaned having the deposit thereon, with a cleaning liquid for a predetermined period; and a physical step of removing physically the deposit by blasting a cleaning media to the member to be cleaned, after said chemical step.

13. A method of cleaning a member on which a deposit is formed, the deposit being formed during plasma processing of a substrate with a processing gas containing at least fluorine gas, which comprises:

in sequence a chemical cleaning step of removing chemically the deposit by contacting the member to be cleaned having the deposit thereon with a cleaning liquid for a predetermined period;

a purging step of purging of the deposit from the member to be cleaned by pressurized air; and then, a physical cleaning step of removing physically the deposit by blasting with a cleaning media the member to be cleaned, after said purging step.

14. A method of cleaning a member on which a deposit is formed, the deposit being formed during plasma processing of a substrate with a processing gas containing at least fluorine gas, which comprises:

in sequence a chemical cleaning step of removing chemically the deposit by contacting the member to be cleaned having the deposit thereon with a cleaning liquid for a predetermined period; and then, a physical cleaning step of removing physically the deposit by blasting with a cleaning media the member to be cleaned, after said chemical cleaning step, wherein the member to be cleaned is dipped in purified water after the physical cleaning step, so as to clean with a supersonic vibration as generated by a supersonic.

* * * * *

UNITED STATES PATENT AND TRADEMARK OFFICE

CERTIFICATE OF CORRECTION

PATENT NO. : 6,790,289 B2
DATED : September 14, 2004
INVENTOR(S) : Takase et al.

It is certified that error appears in the above-identified patent and that said Letters Patent is hereby corrected as shown below:

Title page,
Item [73], Assignee, should read:
-- [73] Assignee: Tokyo Electron Limited, Tokyo (JP) --

Signed and Sealed this

Twenty-first Day of December, 2004

JON W. DUDAS
*Director of the United States Patent and Trademark Office*